US010277988B2

(12) United States Patent
Sridharan et al.

(10) Patent No.: US 10,277,988 B2
(45) Date of Patent: Apr. 30, 2019

(54) CONTROLLING MECHANICAL PROPERTIES OF A MEMS MICROPHONE WITH CAPACITIVE AND PIEZOELECTRIC ELECTRODES

(71) Applicant: Robert Bosch GmbH, Stuttgart (DE)

(72) Inventors: Sucheendran Sridharan, McMurray, PA (US); Andrew Doller, Sharpsburg, PA (US)

(73) Assignee: Robert Bosch GmbH, Stuttgart (DE)

( * ) Notice: Subject to any disclaimer, the term of this patent is extended or adjusted under 35 U.S.C. 154(b) by 127 days.

(21) Appl. No.: 15/065,366

(22) Filed: Mar. 9, 2016

(65) Prior Publication Data

US 2017/0265009 A1 Sep. 14, 2017

(51) Int. Cl.

| | |
|---|---|
| ***H04R 25/00*** | (2006.01) |
| ***H04R 19/04*** | (2006.01) |
| ***H04R 17/02*** | (2006.01) |
| ***H04R 17/00*** | (2006.01) |
| ***H04R 3/00*** | (2006.01) |
| ***H04R 7/02*** | (2006.01) |
| ***H04R 7/26*** | (2006.01) |

(Continued)

(52) U.S. Cl.

CPC ..... *H04R 19/04* (2013.01); *H04R 3/00* (2013.01); *H04R 7/02* (2013.01); *H04R 7/26* (2013.01); *H04R 17/005* (2013.01); *H04R 17/02* (2013.01); *H04R 19/005* (2013.01); *H04R 29/004* (2013.01); *H04R 2201/003* (2013.01)

(58) Field of Classification Search

CPC ..... H04R 17/00; H04R 17/005; H04R 17/02; H04R 19/016; H04R 19/04; H04R 29/004; H04R 2201/003; B81B 2201/0257

USPC ... 381/173, 174, 175, 190, 191, 91, 92, 122, 381/113, 114, 115; 310/322, 323.01, 310/323.06, 324, 326, 327; 257/416, 419

See application file for complete search history.

(56) References Cited

U.S. PATENT DOCUMENTS 5,677,965 A * 10/1997 Moret ..... H04R 19/005 381/113

6,847,090 B2 * 1/2005 Loeppert ..... H04R 19/04 257/418

(Continued)

FOREIGN PATENT DOCUMENTS

DE 102005008511 A1 8/2006

OTHER PUBLICATIONS

International Search Report for Application No. PCP/EP2017/055241 dated May 11, 2017 (4 pages).

*Primary Examiner* — Xu Mei

(74) *Attorney, Agent, or Firm* — Michael Best & Friedrich LLP

(57) ABSTRACT

Microphone systems including a MEMS microphone and an electronic controller. The MEMS microphone includes a movable membrane and a backplate. The movable membrane includes a capacitive electrode and a piezoelectric electrode. The capacitive electrode is configured such that acoustic pressures acting on the movable membrane cause movement of the capacitive electrode. The piezoelectric electrode alters a mechanical property of the MEMS microphone based on a control signal. The backplate is positioned on a first side of the movable membrane. The electronic controller is electrically coupled to the piezoelectric electrode and is configured to generate the control signal.

15 Claims, 6 Drawing Sheets

(51) Int. Cl.
*H04R 29/00* (2006.01)
*H04R 19/00* (2006.01)

(56) References Cited

U.S. PATENT DOCUMENTS

| | | | | |
|---|---|---|---|---|
| 7,146,016 | B2 * | 12/2006 | Pedersen | B81B 3/0072 381/175 |
| 8,447,056 | B2 | 5/2013 | Akino et al. | |
| 8,531,088 | B2 * | 9/2013 | Grosh | H04R 17/00 310/332 |
| 8,824,706 | B2 | 9/2014 | Stephanou et al. | |
| 8,896,184 | B2 | 11/2014 | Grosh et al. | |
| 8,989,411 | B2 | 3/2015 | Hall et al. | |
| 9,049,522 | B2 | 6/2015 | Lee et al. | |
| 9,648,433 | B1 * | 5/2017 | Doller | H04R 29/004 |
| 9,686,617 | B2 * | 6/2017 | Doller | H04R 19/005 |
| 2004/0114778 | A1 | 6/2004 | Gobeli et al. | |
| 2012/0076339 | A1 * | 3/2012 | Buck | H04R 19/016 381/369 |
| 2013/0051587 | A1 | 2/2013 | Stephanou et al. | |
| 2015/0076629 | A1 | 3/2015 | Lee et al. | |
| 2016/0219378 | A1 * | 7/2016 | Hall | H04R 23/02 |

* cited by examiner

CONTROLLING MECHANICAL PROPERTIES OF A MEMS MICROPHONE WITH CAPACITIVE AND PIEZOELECTRIC ELECTRODES

BACKGROUND

Embodiments of the disclosure relate to micro-electro-mechanical system (MEMS) microphones with both capacitive and piezoelectric electrodes. More specifically, the disclosure relates to controlling mechanical properties of capacitive MEMS microphones using piezoelectric members.

SUMMARY

Applying a piezoelectric coating on a capacitive sensor leverages the piezoelectric coating's mechanical-to-electrical reciprocity, such that it can be used to control mechanical properties of the structure.

Thus, one embodiment provides a microphone system including a MEMS microphone and an electronic controller. The MEMS microphone includes a movable membrane and a backplate. The movable membrane includes a capacitive electrode and a piezoelectric electrode. The capacitive electrode is configured such that acoustic pressures acting on the movable membrane cause movement of the capacitive electrode. The piezoelectric electrode alters a mechanical property of the MEMS microphone based on a control signal. The backplate is positioned on a first side of the movable membrane. The electronic controller is electrically coupled to the piezoelectric electrode and is configured to generate the control signal.

Another embodiment provides a microphone system including a MEMS microphone and an electronic controller. The MEMS microphone includes a capacitive electrode, a piezoelectric electrode, and a backplate. The capacitive electrode is configured such that acoustic pressures acting on the capacitive electrode cause movement of the capacitive electrode. The piezoelectric electrode alters a mechanical property of the MEMS microphone based on a control signal. The backplate is positioned on a first side of the capacitive electrode. The electronic controller is electrically coupled to the piezoelectric electrode and is configured to generate the control signal.

Other aspects of the disclosure will become apparent by consideration of the detailed description and accompanying drawings.

DETAILED DESCRIPTION

Figure 1:
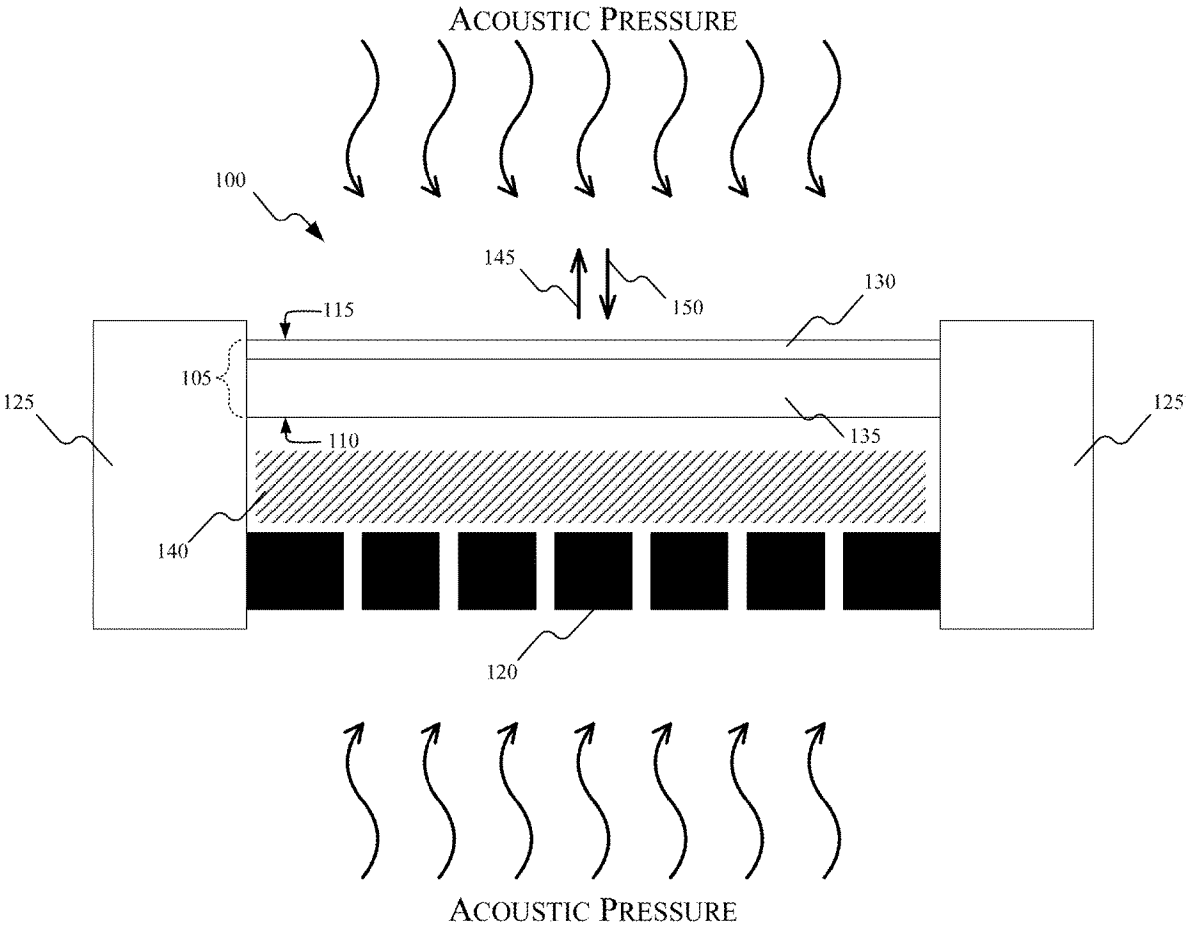
FIG. 1 is a cross-sectional view of a MEMS microphone with a piezoelectric electrode of a movable membrane positioned opposite a backplate, in accordance with some embodiments.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways.

Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Also, electronic communications and notifications may be performed using other known means including direct connections, wireless connections, etc.

It should also be noted that a plurality of hardware and software based devices, as well as a plurality of different structural components may be utilized to implement the disclosure. Furthermore, and as described in subsequent paragraphs, the specific configurations illustrated in the drawings are intended to exemplify embodiments of the disclosure. Alternative configurations are possible.

FIG. 1 illustrates an exemplary embodiment of a MEMS microphone 100. The MEMS microphone 100 illustrated in FIG. 1 includes a movable membrane 105 having a first side 110 and an opposing second side 115, a backplate 120, and a support structure 125. The movable membrane 105 includes a piezoelectric electrode 130 and a capacitive electrode 135. The backplate 120 is a fixed member. In some embodiments, the backplate 120 is positioned on the first side 110 of the movable membrane 105, as illustrated in FIG. 1. In other embodiments, the backplate 120 is positioned on the second side 115 of the movable membrane 105. The movable membrane 105 and the backplate 120 are coupled to the support structure 125.

In some embodiments, the capacitive electrode 135 is kept at a reference voltage and a bias voltage is applied to the backplate 120 to generate an electric sense field 140 between the backplate 120 and the capacitive electrode 135. In other embodiments, the backplate 120 is kept at a reference voltage and a bias voltage is applied to the capacitive electrode 135 to generate the electric sense field 140. In some embodiments, the reference voltage is a ground reference voltage (i.e., approximately 0 Volts). In other embodiments, the reference voltage is a non-zero voltage. The electric sense field 140 is illustrated in FIG. 1 as a plurality of diagonal lines. Deflection of the capacitive electrode 135 in the directions of arrow 145 and 150 modulates the electric sense field 140 between the backplate 120 and the capacitive electrode 135. A voltage difference between the backplate 120 and the capacitive electrode 135 varies based on the electric sense field 140.

Acoustic (and ambient) pressures acting on the first side 110 and the second side 115 of the movable membrane 105 cause movement (e.g., deflection) of the capacitive electrode 135 in the directions of arrow 145 and 150. Thus, the voltage difference between the backplate 120 and the capacitive electrode 135 varies based in part on the acoustic pressures acting on the movable membrane 105.

The piezoelectric electrode 130 is a layer, a film, or material that uses the piezoelectric effect to measure changes in pressure or force by converting them to an electrical charge. In some embodiments, the piezoelectric electrode 130 includes aluminum nitride (AlN). In other embodiments, the piezoelectric electrode 130 includes zinc oxide (ZnO). In other embodiments, the piezoelectric electrode 130 includes lead zirconate titanate (PZT). In the embodiment illustrated in FIG. 1, piezoelectric material is deposited on the second side 115 of the movable membrane 105 so as to form the piezoelectric electrode 130. In such an embodiment, the first side 110 of the movable membrane 105 defines the capacitive electrode 135. In some embodiments, the piezoelectric electrode 130 is formed on the movable membrane 105 by a suitable deposition technique (e.g., atomic layer deposition), and defines a micro-machined piezoelectric membrane.

A control signal is applied to the piezoelectric electrode 130. The control signal causes the shape of the piezoelectric electrode 130 to change. The shape change results in the piezoelectric electrode 130 generating an amount of mechanical pressure acting on the capacitive electrode 135. In some embodiments, the piezoelectric electrode 130 may also generate mechanical pressure acting on the backplate 120 and/or the support structure 125. The mechanical pressure generated by the piezoelectric electrode 130 causes movement of the capacitive electrode 135 in the directions of arrow 145 and 150. As described above, the voltage difference between the backplate 120 and the capacitive electrode 135 varies based in part on the movement of the capacitive electrode 135. Thus, the voltage difference between the backplate 120 and the capacitive electrode 135 varies based in part on the mechanical pressure generated by the piezoelectric electrode 130.

The mechanical pressure generated by the piezoelectric electrode 130, in response to the control signal, alters one or more mechanical properties of the MEMS microphone 100. Mechanical properties of the MEMS microphone 100 include, for example, stiffness, gap size, over travel stop, mass, and mechanical damping.

The stiffness defines a distance that the movable membrane 105 will deflect per unit of applied pressure (e.g., acoustic, ambient, etc.). The stiffness of the movable membrane 105 is based in part on the physical thickness and size of the movable membrane 105. For example, acoustic pressures cause a greater deflection on a thinner movable membrane than on a thicker movable membrane. Increasing the stiffness of the movable membrane 105 provides mechanical damping for the MEMS microphone 100. The control signal causes the shape of the piezoelectric electrode 130 to change. In some embodiments, the piezoelectric electrode 130 alters the stiffness of the movable membrane 105 by changing the physical thickness and/or size of the movable membrane 105 in response to the control signal.

Gap size is the distance between movable membrane 105 and the backplate 120. Gap size varies based on the movement of the movable membrane 105. In some embodiments, the piezoelectric electrode 130 alters the gap size between the movable membrane 105 and the backplate 110 by applying mechanical pressure on the capacitive electrode. 135.

Figure 2:
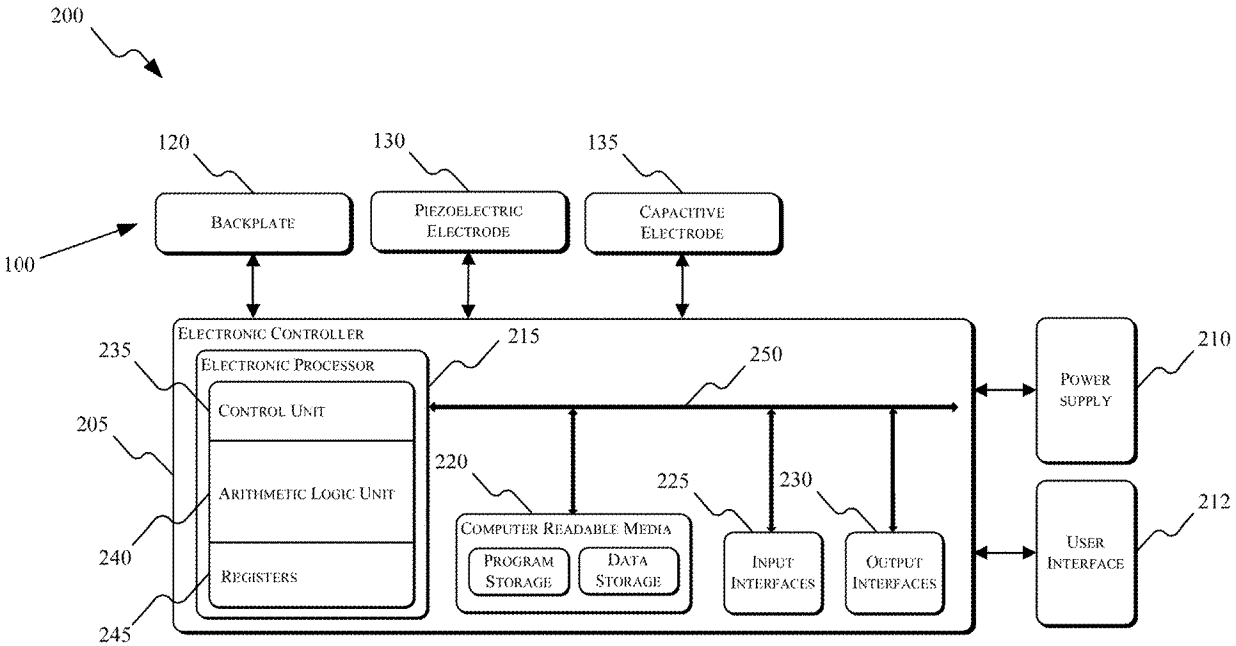
FIG. 2 is a block diagram of a microphone system with the MEMS microphone of FIG. 1, in accordance with some embodiments.

FIG. 2 illustrates an exemplary embodiment of a microphone system 200. The microphone system 200 illustrated in FIG. 2 includes the MEMS microphone 100, an electronic controller 205, a power supply 210, and a user interface 212. Depending on the application, other computer implemented modules not defined herein may be incorporated into the microphone system 200. In some embodiments, the microphone system 200 may include more than one MEMS microphone 100 communicatively connected to any of the computer implemented modules 205, 210, 212.

In some embodiments, the electronic controller 205 includes a plurality of electrical and electronic components that provide power, operational control, and protection to the components and modules within the electronic controller 205, the MEMS microphone 100 and/or the microphone system 200. For example, the electronic controller 205 includes, among other components, an electronic processor 215 (e.g., a microprocessor, a microcontroller, or another suitable programmable device), a memory or computer readable media 220, input interfaces 225, and output interfaces 230. The electronic processor 215 includes, among other things, a control unit 235, an arithmetic logic unit (ALU) 240, and a plurality of registers 245 (shown as a group of registers in FIG. 2), and is implemented using a known computer architecture, such as a modified Harvard architecture, a von Neumann architecture, etc. The electronic processor 215, the computer readable media 220, the input interfaces 225, and the output interfaces 230, as well as the various modules connected to the electronic controller 205 are connected by one or more control and/or data buses (e.g., common bus 250). The control and/or data buses are shown generally in FIG. 2 for illustrative purposes. The use of one or more control and/or data buses for the interconnection between and communication among the various modules and components would be known to a person skilled in the art in view of the disclosure described herein. In some embodiments, the electronic controller 205 is implemented partially or entirely on a semiconductor chip, is a field-programmable gate array (FPGA), is an application specific integrated circuit (ASIC), etc.

The computer readable media 220 includes, for example, a program storage area and a data storage area. The program storage area and the data storage area can include combinations of different types of memory, such as read-only memory (ROM), random access memory (RAM) (e.g., dynamic RAM [DRAM], synchronous DRAM [SDRAM], etc.), electrically erasable programmable read-only memory (EEPROM), flash memory, a hard disk, an SD card, or other suitable magnetic, optical, physical, or electronic memory devices or data structures. The electronic processor 215 is connected to the computer readable media 220 and executes software instructions that are capable of being stored in a RAM of the computer readable media 220 (e.g., during execution), a ROM of the computer readable media 220 (e.g., on a generally permanent basis), or another non-transitory computer readable medium such as another memory or a disc. Software included in some embodiments of the microphone system 200 can be stored in the computer readable media 220 of the electronic controller 205. The software includes, for example, firmware, one or more applications, program data, filters, rules, one or more program modules, and other executable instructions. The electronic controller 205 is configured to retrieve from memory and execute, among other things, instructions related to the control processes and methods described herein. In other constructions, the electronic controller 205 includes additional, fewer, or different components.

The power supply 210 supplies a nominal AC or DC voltage to the electronic controller 205 and/or other components of the microphone system 200. In some embodiments, the power supply 210 is powered by one or more batteries or battery packs. In some embodiments, the power supply 210 is powered by mains power having nominal line voltages between, for example, 100V and 240V AC and frequencies of approximately 50-60 Hz. The power supply 210 is also configured to supply lower voltages to operate circuits and components within the microphone system 200. In some embodiments, the power supply 210 generates, among other things, bias voltages, reference voltages, and control signals.

The user interface 212 may include a combination of digital and analog input and output devices required to achieve a desired level of control and monitoring for the microphone system 200. In some embodiments, the user interface 212 includes a display and a plurality of user-input mechanisms. The display may use any suitable technology including, but not limited to, a liquid crystal display (LCD), a light-emitting diode (LED) display, an organic LED (OLED) display, an electroluminescent display (ELD), a surface-conduction electron-emitter display (SED), a field emission display (FED), and a thin-film transistor (TFT) LCD. The plurality of user-input mechanisms may be, but is not limited to, a plurality of knobs, dials, switches, and buttons. In other embodiments, the user interface 212 may include a touch screen, such as but not limited to, a capacitive touch screen.

The electronic controller 205 is electrically coupled to the backplate 120, the piezoelectric electrode 130, and the capacitive electrode 135. The electronic controller 205 determines the voltage difference between the backplate 120 and the capacitive electrode 135. In some embodiments, the electronic controller 205 determines the voltage difference based in part on a bias voltage that is applied to the backplate 120 by the electronic controller 205. In other embodiments, the electronic controller 205 determines the voltage difference based in part on a bias voltage that is applied to the capacitive electrode 135 by the electronic controller 205.

The electronic controller 205 generates the control signal. In some embodiments, the control signal is a current signal. In some embodiments, the electronic controller 205 generates the control signal based in part on the voltage difference between the backplate 120 and the capacitive electrode 135. In other embodiments, the electronic controller 205 generates the control signal based at least in part on input received via the user interface 212. In other embodiments, the electronic controller 205 generates the control signal based at least in part on the voltage difference between the backplate 120 and the capacitive electrode 135 and input received from via user interface 212.

Figure 3:
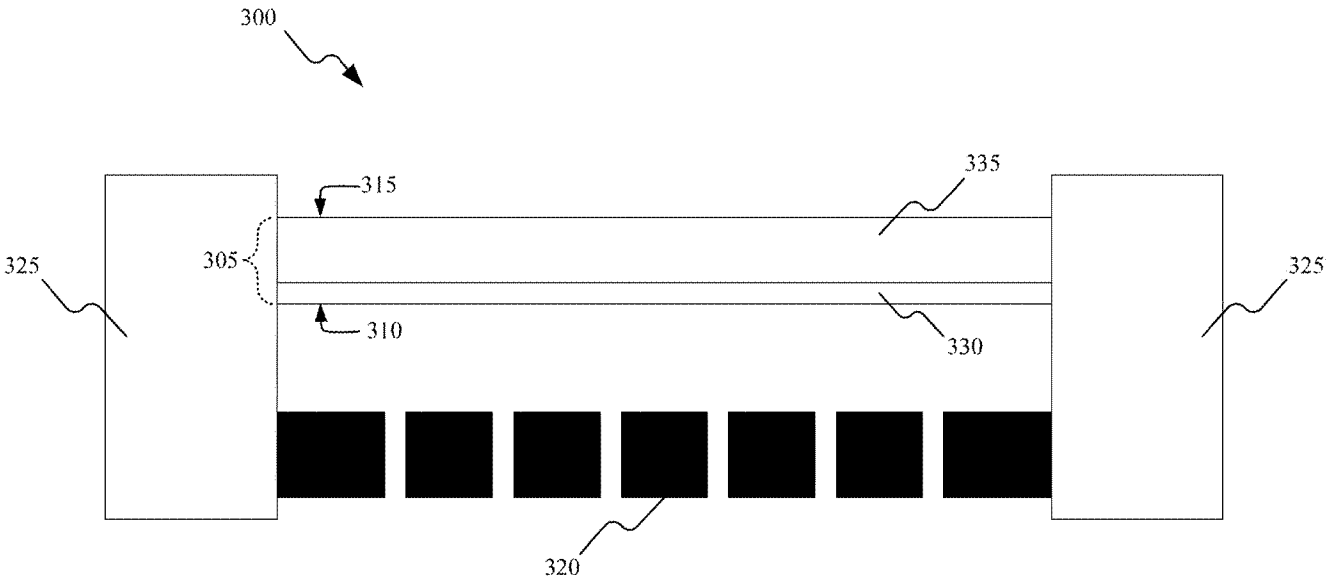
FIG. 3 is a cross-sectional view of a MEMS microphone with a piezoelectric electrode of a movable membrane positioned adjacent to a backplate, in accordance with some embodiments.

FIG. 3 illustrates another exemplary embodiment of a MEMS microphone 300. The MEMS microphone 300 illustrated in FIG. 3 includes a movable membrane 305 having a first side 310 and an opposing second side 315, a backplate 320, and a support structure 325. The movable membrane 305 includes a piezoelectric electrode 330 and a capacitive electrode 335. The backplate 320 is a fixed member. In some embodiments, the backplate 320 is positioned on the first side 310 of the movable membrane 305, as illustrated in FIG. 3. In other embodiments, the backplate 320 is positioned on the second side 315 of the movable membrane 305. The movable membrane 305 and the backplate 320 are coupled to the support structure 325. In the embodiment illustrated in FIG. 3, piezoelectric material is deposited on the first side 310 of the movable membrane 305 so as to form the piezoelectric electrode 330. In such an embodiment, the second side 315 of the movable membrane 305 defines the capacitive electrode 335.

A control signal (e.g., generated by the electronic controller 205) is applied to the piezoelectric electrode 330. The control signal causes the shape of the piezoelectric electrode 330 to change. The shape change results in the piezoelectric electrode 330 generating an amount of mechanical pressure acting on the capacitive electrode 335. The mechanical pressure generated by the piezoelectric electrode 330, in response to the control signal, alters one or more mechanical properties of the MEMS microphone 300. In some embodiments, the piezoelectric electrode 330 may also generate mechanical pressure acting on the backplate 320 and/or the support structure 325.

Figure 4:
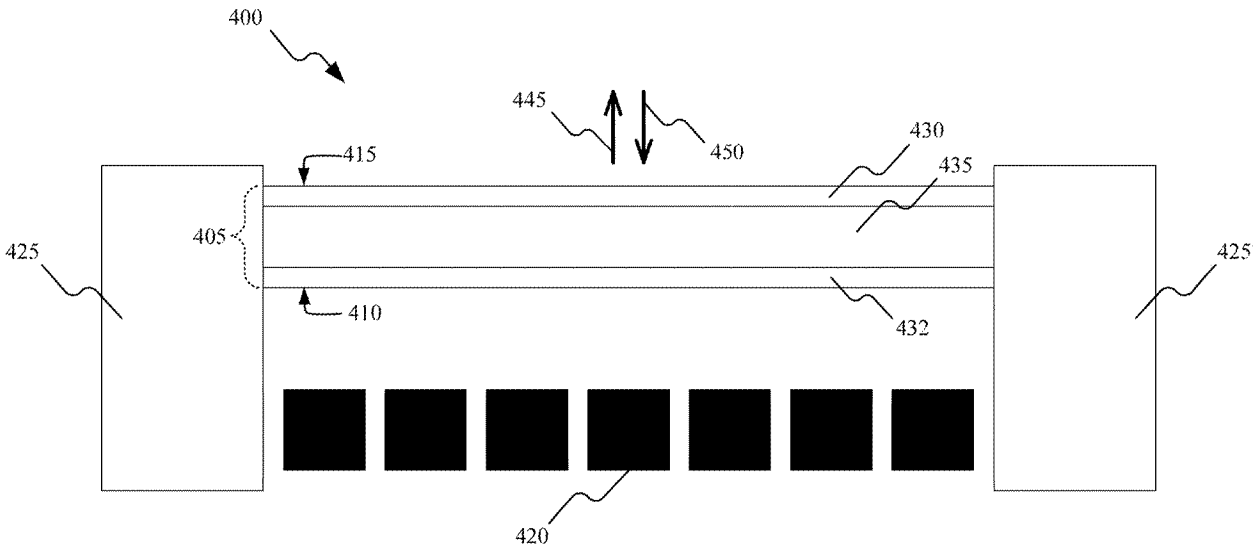
FIG. 4 is a cross-sectional view of a MEMS microphone with two piezoelectric electrodes positioned on opposite sides of a movable membrane, in accordance with some embodiments.

FIG. 4 illustrates another exemplary embodiment of a MEMS microphone 400. The MEMS microphone 400 illustrated in FIG. 4 includes a movable membrane 405 having a first side 410 and an opposing second side 415, a backplate 420, and a support structure 425. The movable membrane 405 includes a first piezoelectric electrode 430, a second piezoelectric electrode 432, and a capacitive electrode 435. The backplate 420 is a fixed member. In some embodiments, the backplate 420 is positioned on the first side 410 of the movable membrane 405, as illustrated in FIG. 4. In other embodiments, the backplate 420 is positioned on the second side 415 of the movable membrane 405. The movable membrane 405 and the backplate 420 are coupled to the support structure 425. In the embodiment illustrated in FIG. 4, piezoelectric material is deposited on the second side 415 of the movable membrane 405 so as to form the first piezoelectric electrode 430. Also, in the embodiment illustrated in FIG. 4, piezoelectric material is deposited on the first side 410 of the movable membrane 405 so as to form the second piezoelectric electrode 432. In such an embodiment, the capacitive electrode 435 is defined in the movable membrane 105 between the first piezoelectric electrode 430 and the second piezoelectric electrode 432. In some embodiments, a plurality of piezoelectric electrodes may be disposed or either one side or both sides of the movable membrane 405.

A first control signal is applied to the first piezoelectric electrode 430. The first control signal causes the shape of the first piezoelectric electrode 430 to change. The shape change results in the first piezoelectric electrode 430 generating a first mechanical pressure acting on the capacitive electrode 435. A second control signal is applied to the second piezoelectric electrode 432. The second control signal causes the shape of the second piezoelectric electrode 432 to change. The shape change results in the second piezoelectric electrode 432 generating a second mechanical pressure acting on the capacitive electrode 435. The first and second mechanical pressures generated by the first and second piezoelectric electrodes 430, 432, in response to the first and second control signals, alter one or more mechanical properties of the MEMS microphone 400. In some embodiments, the first and second piezoelectric electrodes 430, 432 may also generate mechanical pressures acting on the backplate 420 and/or the support structure 425.

The first mechanical pressure generated by the first piezoelectric electrode 430 causes a first movement of the capacitive electrode 435 in the directions of arrow 445 and 450. The second mechanical pressure generated by the second piezoelectric electrode 432 causes a second movement of the capacitive electrode 435 in the directions of arrow 445 and 450. The voltage difference between the backplate 420 and the capacitive electrode 435 varies based in part on the movement of the capacitive electrode 435. Thus, the voltage difference between the backplate 420 and the capacitive electrode 435 varies based in part on the first mechanical pressure generated by the first piezoelectric electrode 430 and the second mechanical pressure generated by the second piezoelectric electrode 432.

Figure 5:
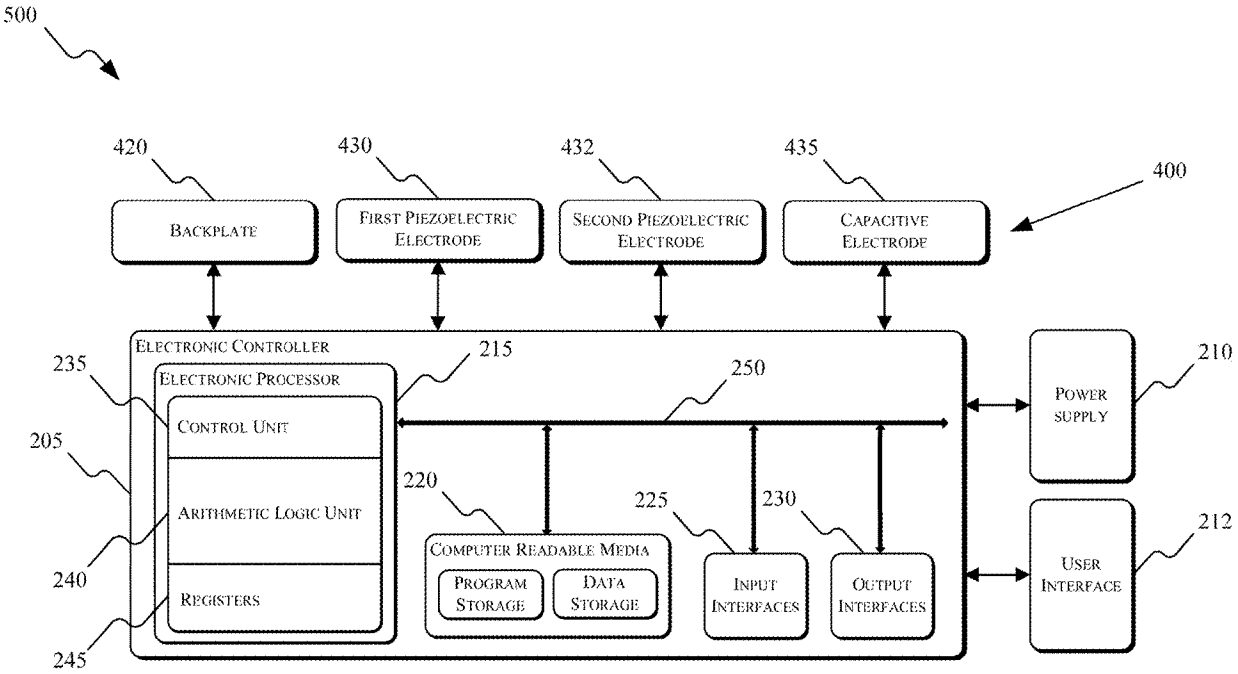
FIG. 5 is a block diagram of a microphone system with the MEMS microphone of FIG. 4, in accordance with some embodiments.

FIG. 5 illustrates another exemplary embodiment of a microphone system 500. The microphone system 500 illustrated in FIG. 5 includes the MEMS microphone 400, the electronic controller 205, the power supply 210, and the user interface 212.

The electronic controller 205 is electrically coupled to the backplate 420, the first piezoelectric electrode 430, the second piezoelectric electrode 432, and the capacitive electrode 435. The electronic controller 205 determines the voltage difference between the backplate 420 and the capacitive electrode 435. In some embodiments, the electronic controller 205 determines the voltage difference based in part on a bias voltage that is applied to the backplate 420 by the electronic controller 205. In other embodiments, the electronic controller 205 determines the voltage difference based in part on a bias voltage that is applied to the capacitive electrode 435 by the electronic controller 205.

The electronic controller 205 generates the first and second control signals. In some embodiments, the first and second control signals are current signals. In some embodiments, the electronic controller 205 generates the first and second control signals based in part on the voltage difference between the backplate 420 and the capacitive electrode 435. In other embodiments, the electronic controller 205 generates the first and second control signals based at least in part on input received from via user interface 212. In other embodiments, the electronic controller 205 generates the first and second control signals based at least in part on the voltage difference between the backplate 420 and the capacitive electrode 435 and input received from via user interface 212. In some embodiments, the electronic controller 205 generates the first and second control signals to control the frequency response of the MEMS microphone 400.

The exemplary embodiment illustrated in FIG. 5 includes the same electronic controller 205 as in the exemplary embodiment illustrated in FIG. 2. As such, the electronic controller 205 is capable of providing a control signal to one or two piezoelectric electrodes depending on the configuration. In some embodiments, the microphone system 500 includes more than one electronic controller 205 coupled to the MEMS microphone 400. As an example, a first electronic controller coupled to the first piezoelectric electrode 430 and a second electronic controller coupled to the second piezoelectric electrode 432. Each controller is capable of providing first and second control signals to the first and second piezoelectric electrodes 430, 432, respectively. However, in other embodiments, an electronic controller may be configured specifically to operate a MEMS microphone with only one piezoelectric electrode or with only two piezoelectric electrodes.

Figure 6:
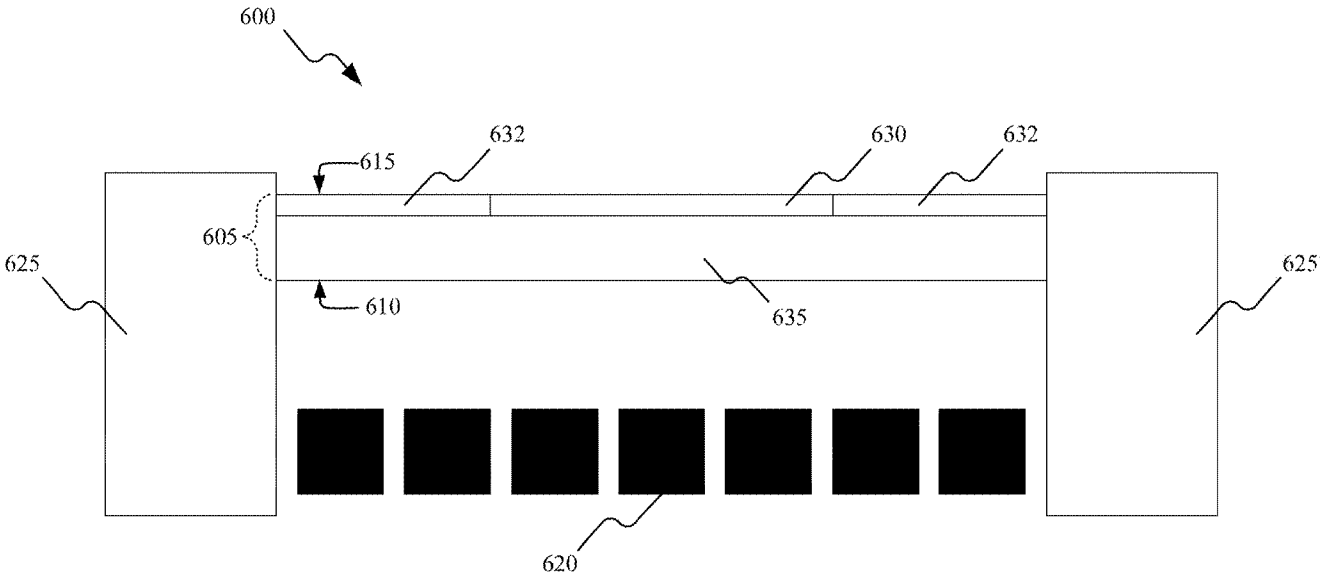
FIG. 6 is a cross-sectional view of a MEMS microphone with two piezoelectric electrodes positioned on the same side of a movable membrane, in accordance with some embodiments.

FIG. 6 illustrates another exemplary embodiment of a MEMS microphone 600. The MEMS microphone 600 illustrated in FIG. 6 includes a movable membrane 605 having a first side 610 and an opposing second side 615, a backplate 620, and a support structure 625. The movable membrane 605 includes a first piezoelectric electrode 630, a second piezoelectric electrode 632, and a capacitive electrode 635. The backplate 620 is a fixed member. In some embodiments, the backplate 620 is positioned on the first side 610 of the movable membrane 605, as illustrated in FIG. 6. In other embodiments, the backplate 620 is positioned on the second side 615 of the movable membrane 605. The movable membrane 605 and the backplate 620 are coupled to the support structure 625.

In the embodiment illustrated in FIG. 6, piezoelectric material is deposited on the second side 615 of the movable membrane 605 so as to form the first piezoelectric electrode 630 and the second piezoelectric electrode 632. In such an embodiment, the first side 610 of the movable membrane 605 defines the capacitive electrode 635. In other embodiments, piezoelectric material is deposited on the first side 610 of the movable membrane 605 so as to form the first piezoelectric electrode 630 and the second piezoelectric electrode 632. In such embodiments, the second side 615 of the movable membrane 605 defines the capacitive electrode 635. In some embodiments, the first piezoelectric electrode 630 is electrically isolated from the second piezoelectric electrode 632 by an insulation layer (not shown).

A first control signal (e.g., generated by the electronic controller 205) is applied to the first piezoelectric electrode 630. The first control signal causes the shape of the first piezoelectric electrode 630 to change. The shape change results in the first piezoelectric electrode 630 generating a first mechanical pressure acting on the capacitive electrode 635. A second control signal (e.g., generated by the electronic controller 205) is applied to the second piezoelectric electrode 632. The second control signal causes the shape of the second piezoelectric electrode 632 to change. The shape change results in the second piezoelectric electrode 632 generating a second mechanical pressure acting on the capacitive electrode 635. The first and second mechanical pressures generated by the first and second piezoelectric electrodes 630, 632, in response to the first and second control signals, alter one or more mechanical properties of the MEMS microphone 600. In some embodiments, different arrangements and geometries of the first and second piezoelectric electrodes 630, 632 may be used, for example, to control the frequency response of MEMS microphone 600.

Although MEMS microphones with piezoelectric electrodes are illustrated and described above, the piezoelectric electrodes can be coupled with movable membranes for other non-acoustic transducers such as pressure sensors, gyroscopes, accelerometers, chemical sensors, environmental sensors, motion sensors, optical sensors, gas sensors, bolometers, temperature sensors, and any suitable semiconductor sensor and transducers.

Thus, the disclosure provides, among other things, a microphone system for controlling mechanical properties of a capacitive MEMS microphone with piezoelectric electrodes. Various features and advantages of the disclosure are set forth in the following claims.

What is claimed is:

1. A microphone system comprising:

a MEMS microphone including a movable membrane having a capacitive electrode layer configured such that acoustic pressures acting on the movable membrane cause movement of the capacitive electrode layer, and a piezoelectric electrode layer covering the capacitive electrode layer and altering a mechanical property of the MEMS microphone based on a control signal, and a backplate positioned on a first side of the movable membrane; and an electronic controller electrically coupled to the piezoelectric electrode layer and configured to generate the control signal;

wherein the mechanical property of the MEMS microphone includes at least one property selected from a group consisting of a stiffness, a gap size, an over travel stop, mass, and a mechanical damping.

2. The microphone system according to claim 1, wherein the electronic controller is electrically coupled to the capacitive electrode layer and the backplate, wherein the electronic controller is further configured to determine a voltage difference between the capacitive electrode layer and the backplate.

3. The microphone system according to claim 2, wherein the electronic controller is further configured to generate the control signal based at least in part on the voltage difference.

4. The microphone system according to claim 1, wherein the piezoelectric electrode layer generates a mechanical pressure acting on the movable membrane based on the control signal.

5. The microphone system according to claim 1, wherein the piezoelectric electrode layer is coupled to a second side of the movable membrane.

6. The microphone system according to claim 1, wherein the movable membrane further has a second piezoelectric electrode layer covering the capacitive electrode layer and altering the mechanical property of the movable membrane based on a second control signal.

7. The microphone system according to claim 6, wherein the electronic controller is electrically coupled to the second piezoelectric electrode layer, wherein the electronic controller is further configured to generate the second control signal.

8. The microphone system according to claim 6, wherein the piezoelectric electrode layer and the second piezoelectric electrode layer are coupled to the second side of the movable membrane.

9. The microphone system according to claim 6, wherein the piezoelectric electrode layer is coupled to the second side of the movable membrane and the second piezoelectric electrode layer is coupled to the first side of the movable membrane.

10. The microphone system according to claim 4, wherein the movable membrane further has a second piezoelectric electrode layer generating a second mechanical pressure acting on the movable membrane based on a second control signal.

11. The microphone system according to claim 1, wherein the microphone system further comprises a user interface electrically coupled to the electronic controller, wherein the electronic controller is further configured to generate the control signal based at least in part on input received via the user interface.

12. A microphone system comprising:

a MEMS microphone including a capacitive electrode configured such that acoustic pressures acting on the capacitive electrode cause movement of the capacitive electrode, and a piezoelectric electrode layer coupled to the capacitive electrode, the piezoelectric electrode layer covering the capacitive electrode and altering a mechanical property of the MEMS microphone based on a control signal, and a backplate positioned on a first side of the capacitive electrode; and an electronic controller electrically coupled to the piezoelectric electrode layer and configured to generate the control signal;

wherein the mechanical property of the MEMS microphone includes at least one property selected from a group consisting of a stiffness, a gap size, an over travel stop, mass, and mechanical damping.

13. The microphone system according to claim 12, wherein the electronic controller is electrically coupled to the capacitive electrode and the backplate, wherein the electronic controller is further configured to determine a voltage difference between the capacitive electrode and the backplate.

14. The microphone system according to claim 13, wherein the electronic controller is further configured to generate the control signal based at least in part on the voltage difference.

15. The microphone system according to claim 13, wherein the piezoelectric electrode layer generates a mechanical pressure acting on the capacitive electrode based on the control signal.

* * * * *